United States Patent [19]

Buist

[11] Patent Number: 4,919,381

[45] Date of Patent: Apr. 24, 1990

[54] CUP HOLDER

[76] Inventor: Ronald W. Buist, 1284 Avon Crescent, Oakville, Ontario, Canada, L6J 2T6

[21] Appl. No.: 308,222

[22] Filed: Feb. 9, 1989

[51] Int. Cl.[5] ..... A47J 47/16

[52] U.S. Cl. ..... 248/154; 220/85 H; 224/42.45 R; 248/311.2; 248/314

[58] Field of Search ..... 248/154, 311.2, 314, 248/309.1, 346, 311.3, 146; 220/85 H; 224/42.45 R

[56] References Cited

U.S. PATENT DOCUMENTS

| | | | |
|---|---|---|---|
| 1,489,698 | 4/1924 | Curtin | 248/154 X |
| 2,729,080 | 1/1956 | Bennett | 248/314 X |
| 2,910,219 | 10/1959 | Bennett et al. | 248/346 X |
| 3,096,960 | 7/1963 | Kinney | 248/314 X |
| 4,040,549 | 8/1977 | Sadler | 248/346.1 X |
| 4,127,211 | 11/1928 | Zerbey | 220/85 H X |
| 4,271,878 | 6/1981 | Bologa | 248/146 X |
| 4,643,381 | 2/1987 | Levy | 248/346.1 X |
| 4,746,028 | 5/1988 | Bagg | 220/85 H |

*Primary Examiner*—Ramon O. Ramirez

[57] ABSTRACT

The cup holder has a cup retainer and a base removable from the retainer. A disposable cup fits within the retainer. One or more tabs project inwardly from the retainer to engage a variey of types of cup. The tabs fit into slots in the retainer. The tabs are bent over where they engage the cup to avoid damaging the cup. The retainer has a handle. The bottom of the retainer has holes under which are flanges, and the base has a corresponding lip. The flanges and the lip enable the cup retainer to be engaged with the base.

16 Claims, 2 Drawing Sheets

CUP HOLDER

FIELD OF THE INVENTION

This invention relates to holders for disposable drinking cups.

BACKGROUND

Most restaurants providing beverages for take-out service employ wax or paper cups. These cups are usually too thin to provide reasonable thermal insulation for the customer from a hot beverage such as coffee. In order to hold a typical cup the customer has to either wrap his hand around the cup and risk being burned or hold the cup at the tip of his fingers to avoid being burned on the hand, but risk dropping the cup and spilling the coffee.

Most take-out customers want to drink their coffee in a car. This can be quite dangerous where the cup is to be held continuously while driving. This is especially so where the beverage is hot and may distract the driver when spilled.

Solutions to the problem of insulating the drinker from the coffee have included finger holes folding out from the side of the cup to form a handle. These types of cups are fairly flimsy and although they provide better insulation than the cup alone they still run the risk of being easily dropped. Additionally, due to the added manufacturing costs restaurants are reluctant to use these types of cups. A customer does not know when he pulls into the restaurant whether he will receive such a cup.

The handled cup does not solve the problem of having to hold the cup while driving.

Recently coffee drinkers have taken to using a two piece coffee cup. Coffee is poured into a cup portion, while a removable base portion is secured to the dash board of a car or other horizontal surface. The cup portion is filled either directly in the restaurant or later by pouring the coffee from the cup provided by the restaurant into the cup portion. Examples of these are described in U.S. Pat. Nos. 899,811 issued to D. A. Stewart on Sept. 29, 1908; 4,040,549 issued to C. J. Sadler on Aug. 9, 1977; 4,127,211 issued to issued to J. E. Zerbey on Nov. 28, 1978; and 4,643,381 issued to L. M. Levy on Feb. 17, 1987.

These types of cups are reusable and should be washed after every use. This is not as easy as it sounds when the customer is on the road. By the time he arrives at a place where he can wash the cup the remaining coffee ha usually dried to the bottom of the cup. Also it is extremely easy to forget to take the cup out of the car. When the driver next wants to use the cup is the time he usually remembers he should have washed it after the last use.

An example of a base holder for disposable paper type cups is disclosed in U.S. Pat. No. 2,910,219 issued to Bennett on Oct. 27, 1959. This holder allows the drinker to use the disposable cup from a restaurant with a re-usable clip-on base. However, the Bennett device does not extend above the base and can become unclipped fairly easily. Additionally, no provision is made to insulate the drinker from a hot beverage which may be in the cup. Furthermore this type of holder does not provide support to the cup which may be relatively fragile. Just a simple clip-on base is provided; there is no teaching or suggestion that this could be retained in a holder permanently mounted on, for example, a car dashboard.

It is an object of the present invention in some of its various aspects to alleviate one or more of these various problems.

SUMMARY

The present invention provides a cup holder for holding a cup, comprising a cup retainer, including a wall dimensioned to loosely receive the cup and at least one resilient tab projecting inwardly from the wall for resiliently gripping the cup.

BRIEF DESCRIPTION OF THE DRAWINGS

For a better understanding of the present invention, and to show more clearly how it may be carried into effect, reference will now be made, by way of example to the accompanying drawings, which show a preferred embodiment of the present invention, and in which.

DETAILED DESCRIPTION OF THE PREFERRED EMBODIMENT

Figure 1:
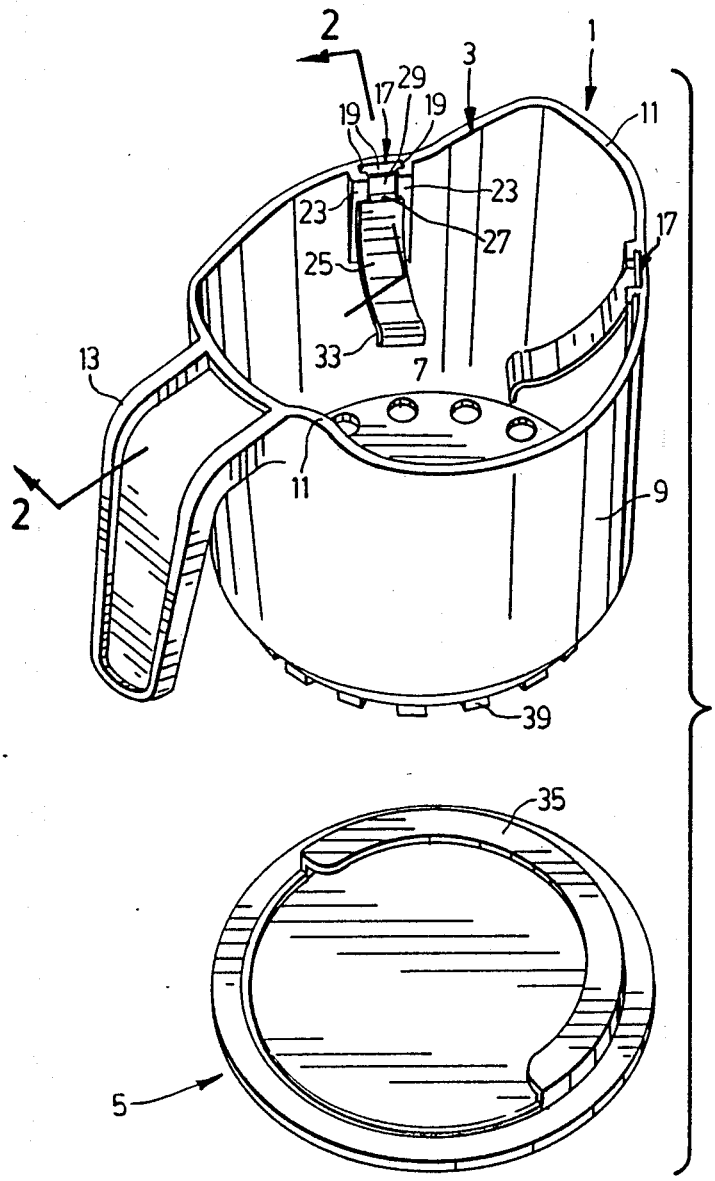
FIG. 1 is a perspective exploded view of a cup holder according to the preferred embodiment of the invention.

Referring now to the drawings, primarily FIG. 1, there is a cup holder 1 made up of a cup retainer 3 and a base 5. The retainer 3 has a bottom 7 and an inverted frusto-conical wall 9 extending upwardly and outwardly from the bottom 7. The upper portion of the wall 9 has opposing support portions 11. There is a handle 13 extending from one of the support portions 11 of the wall 9.

Figure 2:
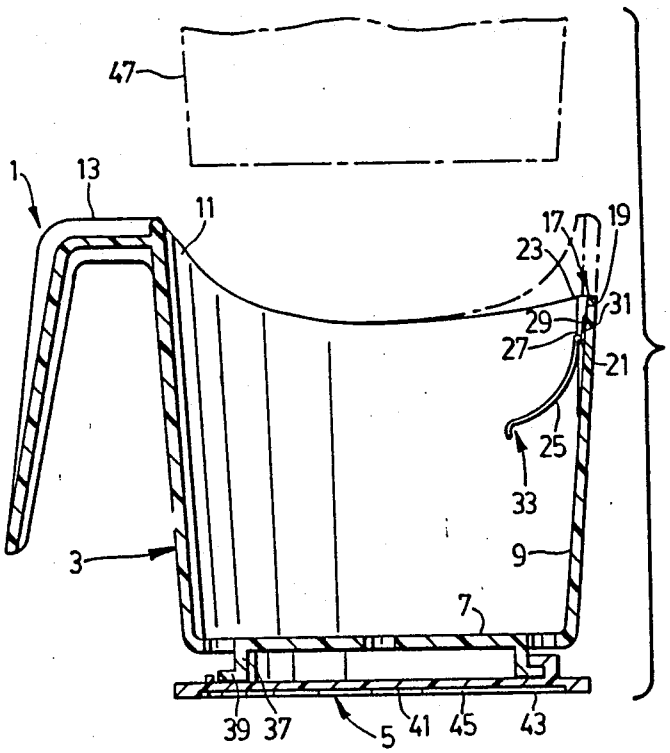
FIG. 2 is a sectional view of the cup holder of FIG. 1 along the line 2—2.

Two slots 17 are positioned in the wall 9 approximately 120 degrees apart and opposite the handle 13. As shown in FIG. 2, each slot 17 has substantially vertical sides 19 and a substantially horizontal sill 21. Each slot 17 has L-shaped, brackets 23 which shape parts of the slot 17. The rest of the slot 17, including the sill 21, is shaped by indenting the wall 9 between the brackets 23. The brackets 23 are of downwardly decreasing profile.

Tabs 25 are dimensioned to fit within the contours of the slots 17. Each tab 25 has a neck 27 of lesser width than the rest of the tab 25. The neck 27 fits in between the opening in the brackets 23. The neck 27 sits on the sill 21. A body 29 having angular shoulders 31 extends upwardly from the neck 27 inside the slot 17. The angular shoulders 31 allow the tab 25 to be easily slipped into the slot 17 during assembly.

As is evident in FIG. 2, the tabs 25, in profile, are approximately one-quarter of a substantially circular arc. The tabs 25 initially point downwardly and then bend inwardly. Innermost end 33 of each tab 25 is ben back downwardly The tabs 25 may be held in place by a glue or other adhesive substance or by applying heat to melt and deform the slots 17 after the tabs 25 are inserted.

The tabs 25 may be formed from a suitable resilient material such as metal or plastic. Metal tabs 25 have been found to stand up best in long term use.

As shown in FIG. 1, the base 5 is circular and has a substantially semi-circular raised lip 35. As shown in FIG. 2, a stem 37 extends downwardly from the bottom 7 and has a series of rectangular flanges 39 projecting outwardly. The flanges 39 fit snugly under the lip 35 and the retainer 3 may be removably attached to the base thereby.

Figure 3:
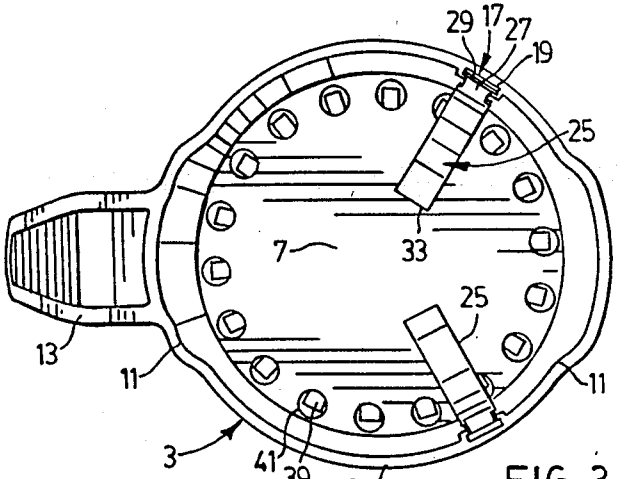
FIG. 3 is a plan view of the cup holder of FIG. 1 from above.
Figure 4:
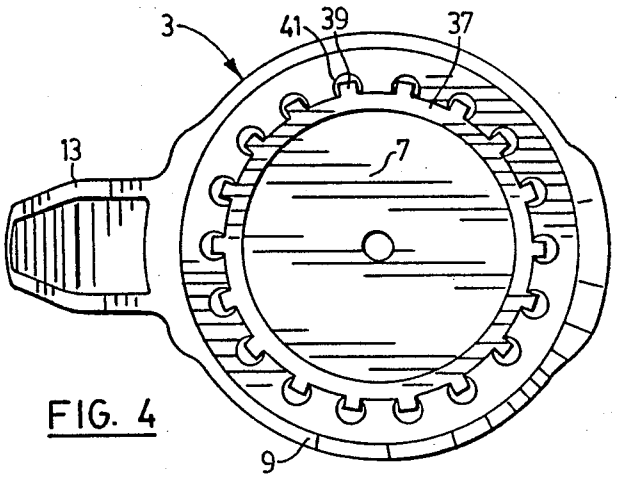
FIG. 4 is a plan view of the cup holder of FIG. 1 from below.

Directly over each flange 39 is a corresponding hole 41. As can be seen in FIGS. 3 and 4, each flange 39 is smaller in area than its corresponding hole 41. This enables a simple two part moulding process to be used to produce the cup as is shown in the moulding field. This can save considerably on manufacturing costs.

An adhesive material 43 is provided on the underside of the base 5 as is known in the art. Usually the adhesive 43 is placed on the outside of a foam pad 45 and the pad 45 is glued with another adhesive 41 to the underside of the base 5.

In operation, the base 5 adheres via the adhesive 43 to the interior of a car, not shown within easy reach of the drinker. The foam pad 45 serves to accommodate any unevenness in the surface. The flanges 39 of the retainer 3 are slipped under the lip 35 of the base 5.

As indicated in FIG. 2, a cup 47, shown in ghosted outline, is placed in the retainer 3. The wall 9 is of sufficiently large circumference to loosely receive the largest size of cup 47 for which the holder 1 is intended to be used.

The cup 47 is engaged by the tabs 25. The tabs 25 are resilient and are deflected by the cup 47. As the tabs 25 are resilient the cup 47 is squeezed between the tabs 25 and the part of the wall 9 opposite the tabs 25. The resiliency of the tabs 25 should be chosen so the tabs 25 can grip the cup 47 without damaging the cup 47.

The drinker can hold the retainer by the handle 13 and remove the retainer 3 from the base 5 when he wishes to drink. The drinker is well insulated from the coffee by the cup 47, the wall 9 and the handle 13. Of course, it is not strictly necessary to have a handle 13, but the added insulative effects are beneficial and the cup can be more readily and securely grasped in a moving vehicle.

The tabs 25 retain the cup 47 in the retainer 3 even when the holder 1 is tipped over as the bent over portion 33 tends to dig into the cup 47. The cups 47 are preferably made from an impressionable material, such as paper or paper coated with wax. As long as the cup 47 is of sufficient circumference the tab 25 resists any forces pulling the cup 47 out of the retainer 3 and tending to bend back the tab 25. The bent over part 33 aids in preventing the tabs 25 from tearing a hole in the cup 47.

Although the invention has been described with reference to a preferred embodiment 1 having two tabs 25, it is possible to achieve many of the advantages of the invention using just one or more tabs 25. The inventor has found using two tabs 25 is the most flexible embodiment. Embodiments with a single 25 do not work as well with smaller size cups 47 and embodiments with three or more tabs 25 do not work as well with larger cups 47.

It is to be understood that the invention has been described with reference to the preferred embodiment thereof, however, other and further embodiments will be evident to those skilled in the art as defined by the following claims.

I claim:

1. A cup holder for holding a cup, comprising a cup retainer including a wall dimensioned to loosely receive the cup and at least one resilient tab projecting inwardly from the wall for resiliently gripping the cup, the cup retainer further including a respective slot in the wall for each tab, each slot having substantially vertical sides and a sill and for each slot, the wall having a pair of opposing, spaced apart, L-shaped brackets providing an opening, the wall being indented between the brackets to form the slot.

2. A cup holder as claimed in claim 1, wherein there are two tabs.

3. A cup holder as claimed in claim 1, wherein there is only one tab.

4. A cup holder as claimed in claim 1, wherein there are three tabs.

5. A cup holder as claimed in claim 2, wherein the cup retainer includes a handle, and wherein the two tabs are spaced apart by approximately 120 degrees and are opposite the handle.

6. A cup holder as claimed in claim 1, wherein each tab has a neck dimensioned to fit through the opening and a body broader than the neck dimensioned to fit in the slot.

7. A cup holder as claimed in claim 1 wherein the cup retainer includes a handle and two tabs with corresponding slots, with the tabs spaced apart by 120° and mounted symmetrically opposite the handle.

8. A cup holder as claimed in claim 7, wherein each tab is fixed within its slot to the wall by an adhesive.

9. A cup holder as claimed in claim 7, wherein each tab is approximately one-quarter of a circle commencing downwardly and curving inwardly and is formed from metal.

10. A cup holder as claimed in claim 7, wherein each tab is approximately one quarter of a circle commencing downwardly and curving inwardly having an innermost portion bent over downwardly.

11. A cup holder as claimed in claim 1, wherein the cup holder further comprises a base and wherein, the cup retainer is adapted for removable attachment to the base.

12. A cup holder as claimed in claim 11, wherein the cup retainer further includes a bottom, a stem projecting downwardly from the bottom and at least one flange projecting generally radially from the stem and wherein the base includes, a raised arcuate lip, the retainer being adapted to removable attachment to the base by engagement of each flange with the lip.

13. A cup holder as claimed in claim 12, wherein the cup retainer includes a plurality of flanges and the bottom has a hole over each flange, the hole having a greater area than the flange.

14. A cup holder for holding a cup, comprising a cup retainer including, a wall dimensioned to loosely receive the cup and at least one resilient tab projecting inwardly from the wall for resiliently gripping the cup, the cup holder further comprising a base, the cup retainer being adapted for removable attachment to the base and including a bottom, a stem projecting downwardly from the bottom and a plurality of flanges projecting generally radially from the stem, the bottom having a hole over each flange, each hole having a greater area than the respective flange and wherein the base includes a raised arcuate lip, the retainer being adapted to removable attachment to the base by engagement of the flanges with the lip.

15. A cup holder as claimed in claim 6, wherein the flanges are uniformly spaced and extend radially outwards, and the arcuate lip extends radially inwards through approximately a semicircle.

16. A cup holder as claimed in claim 15, wherein each flange is generally rectangular.

* * * * *